US006261038B1

(12) United States Patent
Cowan

(10) Patent No.: US 6,261,038 B1
(45) Date of Patent: Jul. 17, 2001

(54) CARGO THEFT PREVENTION SYSTEM

(76) Inventor: Jimmy D. Cowan, 520 Basswood Dr., Laredo, TX (US) 78045-7720

( * ) Notice: Subject to any disclaimer, the term of this patent is extended or adjusted under 35 U.S.C. 154(b) by 0 days.

(21) Appl. No.: 09/627,697

(22) Filed: Jul. 28, 2000

(51) Int. Cl.[7] ..... B60P 7/14
(52) U.S. Cl. ..... 410/94; 410/121; 410/129
(58) Field of Search ..... 410/94, 95, 121, 410/129; 248/351; 105/355

(56) References Cited

U.S. PATENT DOCUMENTS

| | | | | |
|---|---|---|---|---|
| D. 265,720 | | 8/1982 | Harrison . | |
| 1,499,229 | * | 6/1924 | Laffey | 410/129 |
| 2,978,993 | * | 4/1961 | Hall | 410/129 |
| 3,025,804 | * | 3/1962 | Bruning | 410/129 |
| 3,429,281 | * | 2/1969 | Gutridge | 410/95 |
| 3,637,094 | * | 1/1972 | Grey | 410/129 |
| 4,498,824 | * | 2/1985 | Kinkle | 410/121 |
| 4,695,211 | * | 9/1987 | Van Iperen et al. | 410/94 X |
| 5,029,909 | | 7/1991 | Bunger . | |
| 5,037,256 | | 8/1991 | Schroeder | 410/143 |
| 5,085,326 | | 2/1992 | Russell et al. . | |
| 5,154,458 | | 10/1992 | Cook et al. . | |
| 5,405,226 | | 4/1995 | Daves | 410/32 |
| 6,099,220 | * | 8/2000 | Poth | 410/94 |

* cited by examiner

*Primary Examiner*—Stephen T. Gordon

(57) ABSTRACT

A new Cargo Theft Prevention System for providing a pivotable barrier-type assembly associateable with the doors of a conventional cargo container thereby preventing opening of the doors. The inventive device includes a panel pivotally mounted to a rail car floor, and at least two locking shafts removably secured to the floor a finite distance from the panel and removably engaging the panel to support the panel substantially parallel to the door of a cargo box to prevent opening.

8 Claims, 4 Drawing Sheets

CARGO THEFT PREVENTION SYSTEM

BACKGROUND OF THE INVENTION

1. Field of the Invention

The present invention relates to Cargo Load Protective Devices and more particularly pertains to a new Cargo Theft Prevention System for providing a pivotable barrier-type assembly associateable with the doors of a conventional cargo container thereby preventing opening of the doors.

2. Description of the Prior Art

The use of Cargo Load Protective Devices is known in the prior art. More specifically, Cargo Load Protective Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Cargo Load Protective Devices include U.S. Pat. No. 5,405,226; U.S. Pat. No. 5,154,458; U.S. Design Pat. No. 265,720; U.S. Pat. No. 5,085,326; U.S. Pat. No. 5,037,256 and U.S. Pat. No. 5,029,909.

While these devices fulfill their respective, particular objectives and requirements, the aforementioned patents do not disclose a new Cargo Theft Prevention System. The inventive device includes a panel pivotally mounted to a rail car floor, and at least two locking shafts removably secured to the floor a finite distance from the panel and removably engaging the panel to support the panel substantially parallel to the door of a cargo box to prevent opening.

In these respects, the Cargo Theft Prevention System according to the present invention substantially departs from the conventional concepts and designs of the prior art, and in so doing provides an apparatus primarily developed for the purpose of providing a pivotable barrier-type assembly associateable with the doors of a conventional cargo container thereby preventing opening of the doors.

SUMMARY OF THE INVENTION

In view of the foregoing disadvantages inherent in the known types of Cargo Load Protective Devices now present in the prior art, the present invention provides a new Cargo Theft Prevention System construction wherein the same can be utilized for providing a pivotable barrier-type assembly associateable with the doors of a conventional cargo container thereby preventing opening of the doors.

The general purpose of the present invention, which will be described subsequently in greater detail, is to provide a new Cargo Theft Prevention System apparatus and method which has many of the advantages of the Cargo Load Protective Devices mentioned heretofore and many novel features that result in a new Cargo Theft Prevention System which is not anticipated, rendered obvious, suggested, or even implied by any of the prior art Cargo Load Protective Devices, either alone or in any combination thereof.

To attain this, the present invention generally comprises a panel pivotally mounted to a rail car floor, and at least two locking shafts removably secured to the floor a finite distance from the panel and removably engaging the panel to support the panel substantially parallel to the door of a cargo box to prevent opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Cargo Theft Prevention System apparatus and method which has many of he advantages of the Cargo Load Protective Devices mentioned heretofore and many novel features that result in a new Cargo Theft Prevention System which is not anticipated, rendered obvious, suggested, or even implied by any of the prior art Cargo Load Protective Devices, either alone or in any combination thereof.

It is another object of the present invention to provide a new Cargo Theft Prevention System which may be easily and efficiently manufactured and marketed.

It is a further object of the present invention to provide a new Cargo Theft Prevention System which is of a durable and reliable construction.

An even further object of the present invention is to provide a new Cargo Theft Prevention System which is susceptible of a low cost of manufacture with regard to both materials and labor, and which accordingly is then susceptible of low prices of sale to the consuming public, thereby making such Cargo Theft Prevention System economically available to the buying public.

Still yet another object of the present invention is to provide a new Cargo Theft Prevention System which provides in the apparatuses and methods of the prior art some of the advantages thereof, while simultaneously overcoming some of the disadvantages normally associated therewith.

Still another object of the present invention is to provide a new Cargo Theft Prevention System for providing a pivotable barrier-type assembly associateable with the doors of a conventional cargo container thereby preventing opening of the doors.

Yet another object of the present invention is to provide a new Cargo Theft Prevention System which includes a panel pivotally mounted to a rail car floor, and at least two locking shafts removably secured to the floor a finite distance from the panel and removably engaging the panel to support the panel substantially parallel to the door of a cargo box to prevent opening.

Still yet another object of the present invention is to provide a new Cargo Theft Prevention System that blocks access to the door of a cargo box.

Even still another object of the present invention is to provide a new Cargo Theft Prevention System that reduces thefts from railroads thereby saving freight customers money.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
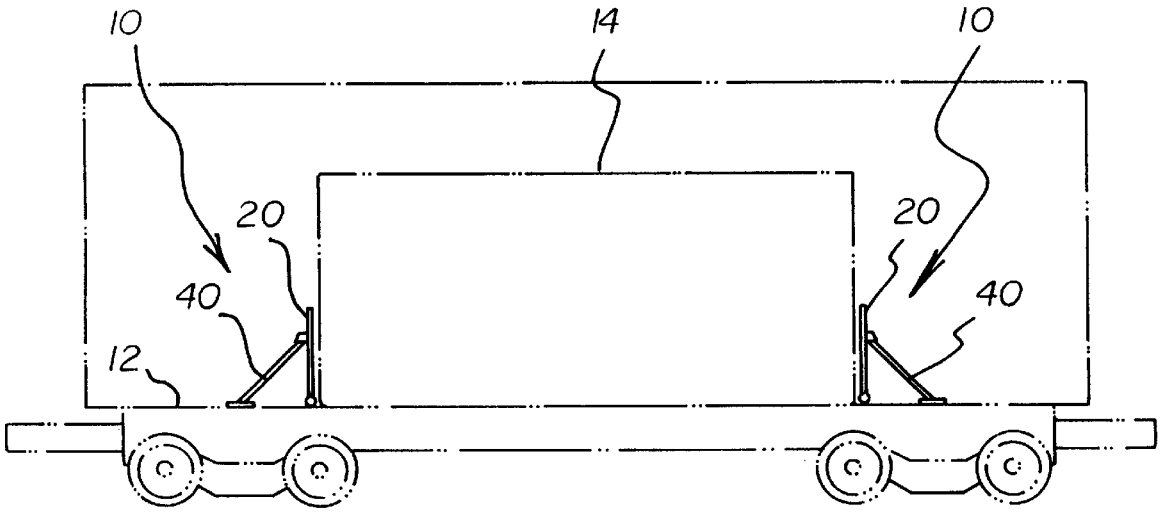
FIG. 1 is a side view of a new Cargo Theft Prevention System according to the present invention.

With reference now to the drawings, and in particular to FIGS. 1 through 8 thereof, a new Cargo Theft Prevention System embodying the principles and concepts of the present invention and generally designated by the reference numeral 10 will be described.

More specifically, it will be noted that the Cargo Theft Prevention System 10 comprises a panel 20 pivotally mounted to a rail car floor 12, and at least two locking shafts 40 removably secured to the floor 12 a finite distance from the panel 20 and removably engaging the panel 20 to support the panel 20 substantially parallel to the door of a cargo box 14 to prevent opening.

Figure 2:
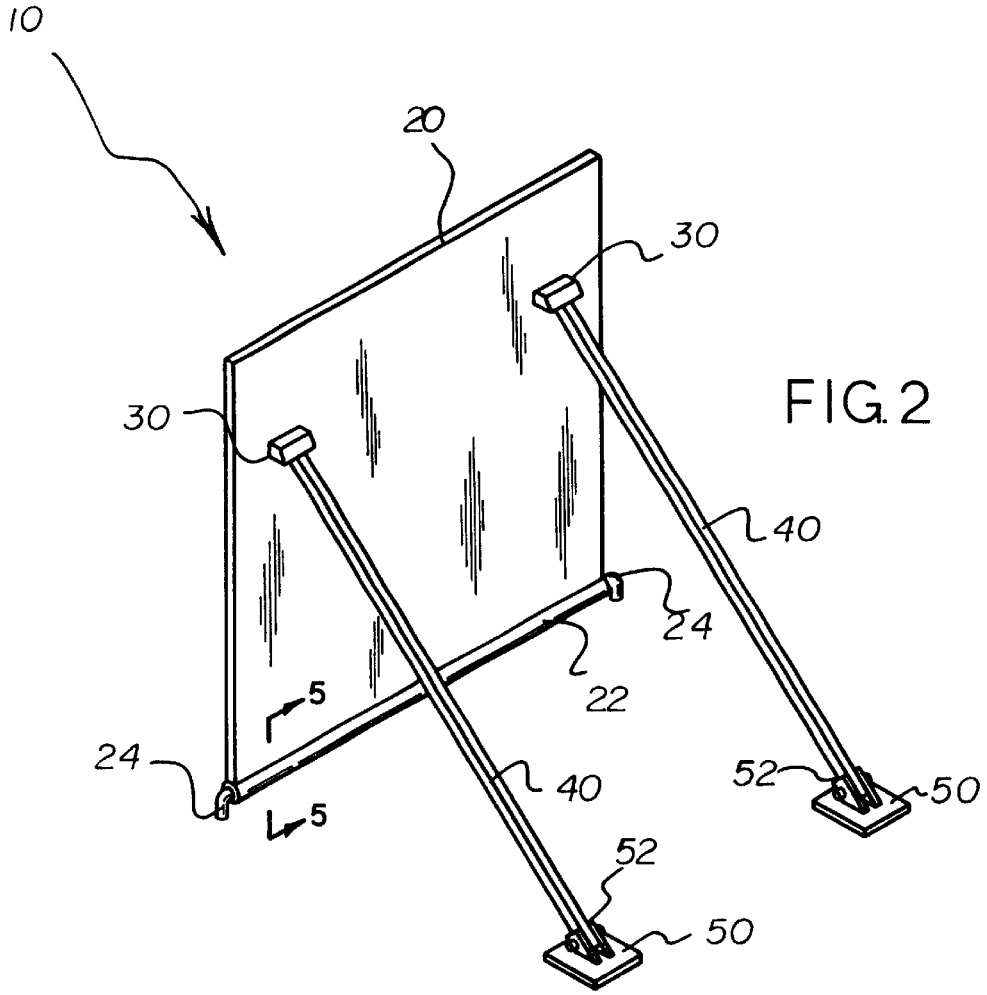
FIG. 2 is an upper perspective view of the present invention.
Figure 3:
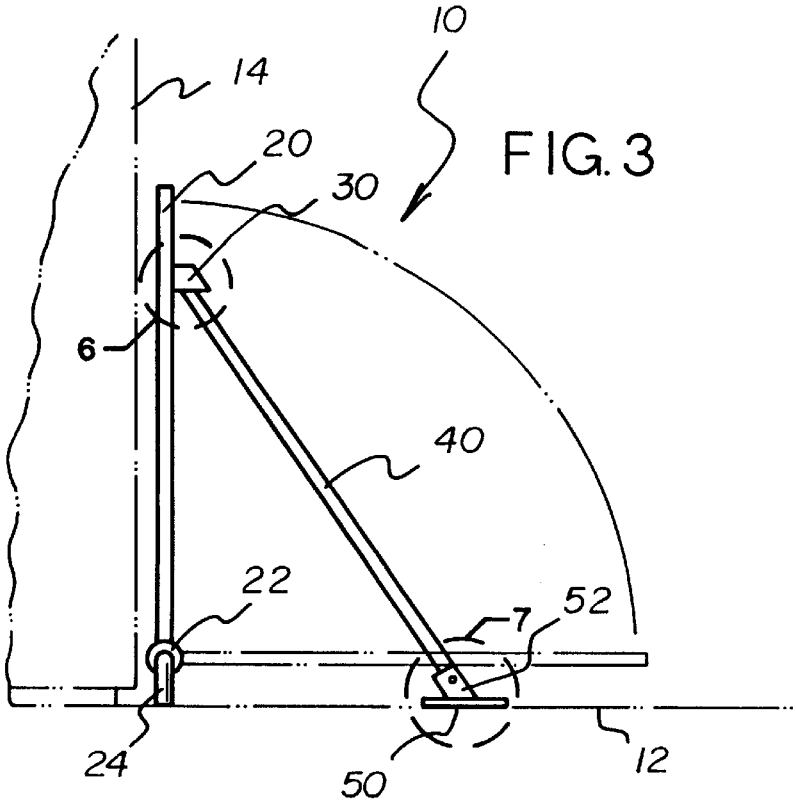
FIG. 3 is a side view of the present invention.
Figure 4:
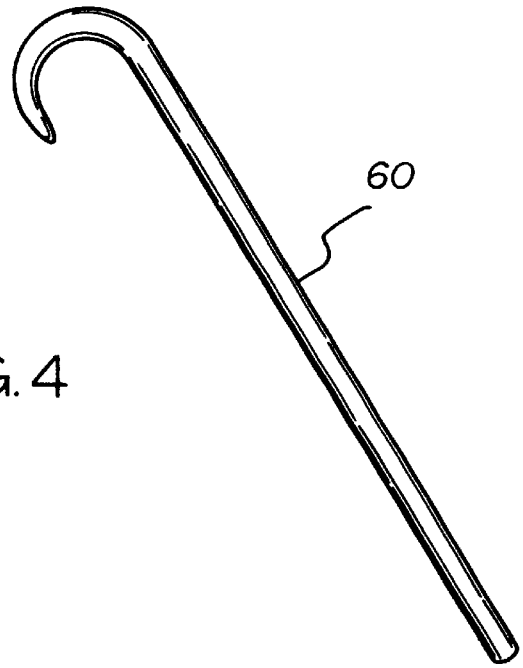
FIG. 4 is a perspective view of a hook pole.
Figure 5:
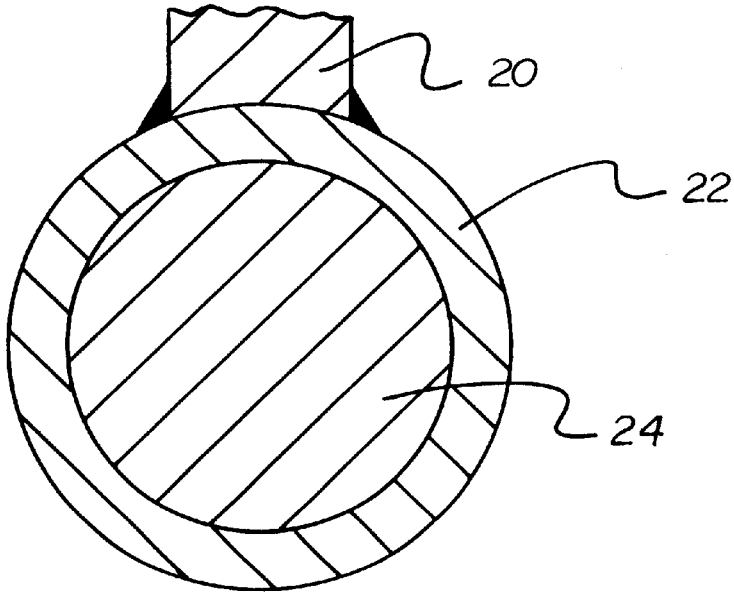
FIG. 5 is a cross sectional view taken along line 5—5 of FIG. 2.
Figure 6:
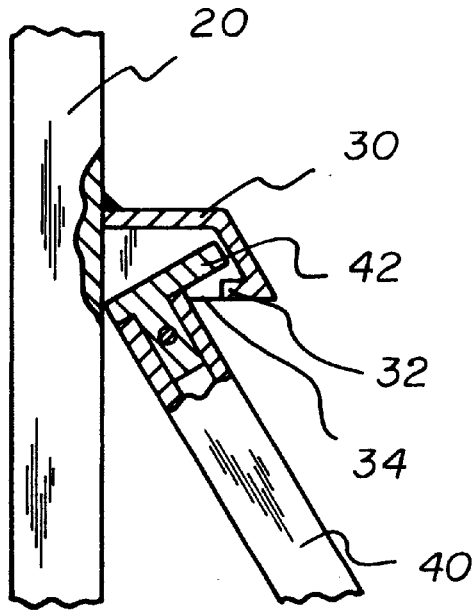
FIG. 6 is a cut away magnified view from FIG. 3.
Figure 7:
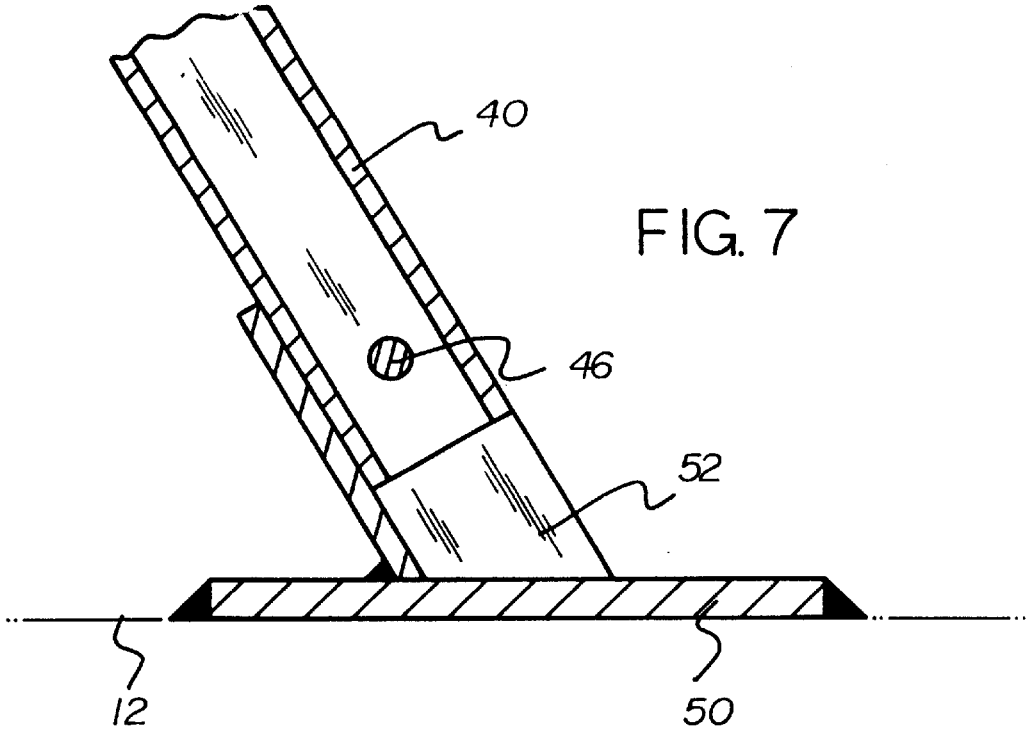
FIG. 7 is a cut away magnified view from FIG. 3 disclosing the base plate and U-shaped member.
Figure 8:
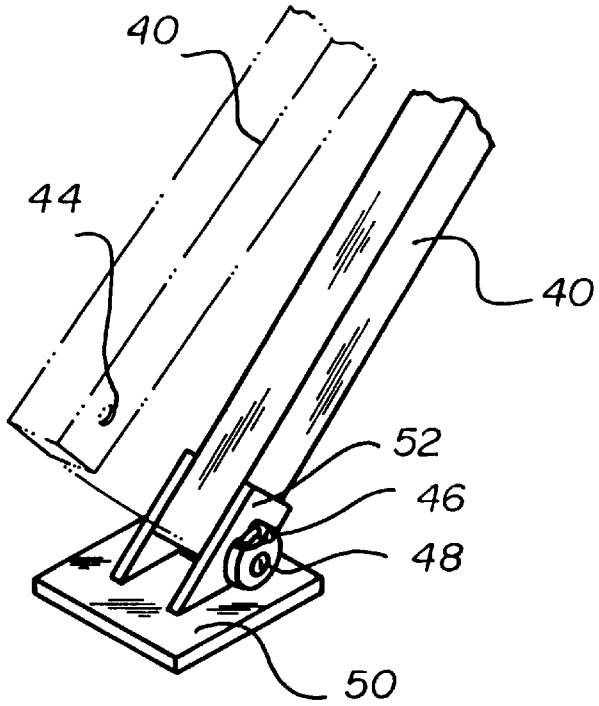
FIG. 8 is an upper perspective view of the securing brace removably secured to the U-shaped member.

As shown in FIGS. 1 through 3, the panel 20 is pivotally secured to a rail car floor 12 near the door of the cargo box 14. The securing brace 30 is secured near the upper portion of the panel 20 extending orthogonally a finite distance and thereafter angled downwardly towards the rail car floor 12 a finite distance and both ends are enclosed. As best shown in FIG. 6 of the drawings, a lip 32 is secured to the end of the securing brace 30 opposite of the panel 20 extending orthogonal to and towards the panel 20 a finite distance defining an opening 34. At least one base plate 50 is secured to the rail car floor 12 a finite distance from the panel 20 as shown in FIGS. 1, 3 and 7. A U-shaped member 52 is secured to the base plate 50 at an angle towards the panel 20 as shown in FIGS. 7 and 8. At least one locking shaft 40 is removably secured to the U-shaped member 52 at one end. A locking member 42 is secured to the end of the locking shaft 40 opposite of the U-shaped member 52 extending a finite distance orthogonally to the longitudinal axis of the locking shaft 40. The locking member 42 projects through the opening 34 and engages the lip 32 thereby preventing the panel 20 from pivoting as best disclosed in FIG. 6 of the drawings. The locking shaft 40 has an aperture 44 and the U-shaped member 52 has an aperture 44 corresponding to the aperture 44 of the locking shaft 40. A fastener 46 slidably projects through the aperture 44 of the locking shaft 40 and the aperture 44 of the U-shaped member 52. A lock 48 is removably engaging the fastener 46 thereby preventing removal of the locking shaft 40 from the U-shaped member 52. An elongated tube 22 is secured along the edge to the bottom edge of the panel 20 as shown in FIGS. 2, 3 and 5. An elongated rod 24 has both ends orthogonal to the longitudinal axis of the elongated rod 24 as shown in FIG. 2. The elongated rod 24 projects through the elongated tube 22 thereby pivotally securing the elongated tube 22. The ends of the elongated rod 24 are secured to the rail car floor 12. The panel 20 preferably is constructed from reinforced steel.

In use, the panel 20 is pivotally positioned substantially parallel to the door of the cargo box 14 by utilizing a hook pole 60. The locking shaft 40 is positioned within the securing brace 30 at one end. The opposite end of the locking shaft 40 is locked into the U-shaped member 52 to prevent the panel 20 from pivoting about the elongated rod 24. To access the door of the cargo box 14 the above process is simply reversed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A cargo theft prevention system comprising:

a panel pivotally secured to a rail car floor near a cargo box door;

a securing brace being secured near the upper portion of said panel extending orthogonally a finite distance and thereafter angled downwardly towards said rail car floor a finite distance; said brace defining two ends wherein both of said ends are enclosed;

a lip secured to one of said ends of said securing brace opposite of said panel extending orthogonal to and towards said panel a finite distance, said lip defining an opening;

at least one base plate secured to said rail car floor a finite distance from said panel;

a U-shaped member secured to said base plate at an angle towards said panel;

at least one locking shaft removably secured to said U-shaped member at one end; and a locking member secured to an end of said locking shaft opposite of said U-shaped member extending a finite distance orthogonally to a longitudinal axis of said locking shaft, where said locking member projects through said opening and engages said lip thereby preventing said panel from pivoting.

2. The cargo theft prevention system of claim 1, wherein:

said locking shaft including an aperture;

said U-shaped member including an aperture corresponding to said aperture of said locking shaft;

a fastener slidably projecting through said aperture of said locking shaft and said aperture of said U-shaped member; and a lock removably engaging said fastener thereby preventing removal of said locking shaft from said U-shaped member.

3. The cargo theft prevention system of claim 1, wherein:

an elongated tube is secured along the bottom edge of said panel; and an elongated rod having both ends orthogonal to the longitudinal axis of said elongated rod, where said elongated rod projects through said elongated tube thereby pivotally securing said elongated tube.

4. The cargo theft prevention system of claim 1, wherein said panel comprises reinforced steel.

5. A cargo theft prevention system comprising:

a panel pivotally mounted on a rail car floor such that the panel may be pivoted between a lowered and a raised condition, the panel having an upper portion;

an elongate securing brace being secured to the panel near the upper portion thereof, said brace having opposite ends;

a cup member mounted on the upper portion of the panel, the cup member defining a cavity for removably receiving a first one of the opposite ends of the brace to thereby releasably secure the first end of the brace to the panel and support the panel in the raised condition;

a base mounted on said rail car floor a finite distance from said panel, said base comprising:

a channel member mounted on said rail car floor, the channel having a pair of sides, each of said sides having an aperture formed therein, the apertures of the sides being axially aligned, a second end of said brace having a hole alignable with the apertures in the sides of the channel member;

a lock pin removably extended through said apertures on said channel member and said hole of said second end of said brace for releasably securing said second end of said brace to said base on said rail car floor; and a lock removably mounted on said lock pin for selectively preventing removal of said lock pin from said apertures of said sides and said hole in said brace for preventing removal of said brace from said base.

6. The cargo theft prevention system of claim 5 wherein said cup member includes a lip extending into said cavity for resisting removal of said first end of said brace from said cup member when said second end of said brace is secured to said base and said panel is positioned in said raised position.

7. The cargo theft prevention system of claim 5 wherein an elongated tube is mounted on a lower portion of said panel; and an elongated rod extends through the elongated tube, the elongated rod having ends mounted to the rail car floor.

8. The cargo theft prevention system of claim 5 wherein said panel comprises steel.

* * * * *